US006098560A

United States Patent [19]

Kyle

[11] Patent Number: 6,098,560

[45] **Date of Patent: *Aug. 8, 2000**

[54] ROLLER FURLING APPARATUS

[75] Inventor: James H. Kyle, Charlestown, N.H.

[73] Assignee: Pompanette, Inc., Charlestown, N.H.

[ * ] Notice: This patent is subject to a terminal disclaimer.

[21] Appl. No.: 09/177,623

[22] Filed: Oct. 23, 1998

Related U.S. Application Data

[63] Continuation-in-part of application No. 08/926,680, Sep. 10, 1997, Pat. No. 5,899,163.

[51] Int. Cl.[7] ..... B63H 9/04

[52] U.S. Cl. ..... 114/106

[58] Field of Search ..... 114/102.1, 104, 114/105, 106, 107

[56] References Cited

U.S. PATENT DOCUMENTS

| | | | |
|---|---|---|---|
| 3,789,790 | 2/1974 | Crall | 114/106 |
| 4,248,281 | 2/1981 | Hood | 114/106 |
| 4,723,499 | 2/1988 | Furgang | 114/106 |
| 5,878,683 | 3/1999 | Kyle | 114/106 |
| 5,899,163 | 5/1999 | Kyle | 114/106 |

*Primary Examiner*—Stephen Avila
*Attorney, Agent, or Firm*—Dougherty & Troxell

[57] ABSTRACT

A plastic roller furling apparatus includes an elongated member or furling element and one or more longitudinally extending wires encased therein. The wire or wires of twisted stainless steel are extruded or molded into the member. The member also defines a central opening or passageway which is dimensioned to fit loosely around a stay on which the apparatus is installed. The furling element also includes one or two grooved luff foils which are formed in and extended along the length of the plastic member. Bearing means are also provided at or near the base of the plastic member and a furling drum or jib sail spool is used to rotate the plastic member about a stay to furl the sail. The plastic member may also include longitudinally extending segments which divide the plastic member into two pieces. The segments each include fastening means for fastening the two segments together along their length. When fastened together the two segments define a central opening for fitting around the headstay of the sailboat. A split body member is also provided and clamps around the elongated plastic member.

4 Claims, 11 Drawing Sheets

ROLLER FURLING APPARATUS

This is a Continuation-In-Part of U.S. patent application Ser. No. 08/926,680 which was filed on Sep. 10, 1997 now U.S. Pat. No. 5,899,163 issued May 4, 1999.

FIELD OF THE INVENTION

This invention relates to a roller furling apparatus for installation on a stay of a sailboat and more particularly to a wire reinforced plastic roller furling apparatus.

BACKGROUND FOR THE INVENTION

Roller furling systems, such as disclosed in the U.S. Patent of Crall, U.S. Pat. No. 3,789,790 have been in use for many years. Such systems typically include a sleeve or torsion element which surrounds a forward stay on a sailboat. The systems also typically include means such as a jib sail spool which sits on and rotates about a bearing for winding and unwinding i.e., furling or unfurling a sail. Means are also provided for rotating the jib sail spool.

More recent developments such as those disclosed by Hood, U.S. Pat. No. 4,248,281 and Dahmen, U.S. Pat. No. 4,821,664 have facilitated sail changes and led to an increased demand for roller furling devices.

Nevertheless, there are a number of shortcoming associate with the prior art roller furlers and it is believed that there may be a large commercial demand for a roller furler which overcomes those shortcomings. For example, roller furlers are typically installed over an existing headstay and require some disassembly of the standing rigging. For this reason, a number of sailors are intimidated by the installation and then turn to a professional which adds to the cost of the roller furler. Some sailors may also be intimidated by the cost of a typical roller furler and would be attracted to a less expensive device.

It has now been found that a roller furling apparatus in accordance with the present invention overcomes the aforementioned shortcomings and offers a number of advantages over prior art furlers. For example, roller furlers in accordance with the present invention are designed for installation over an existing headstay with a headstay intact and in place. Accordingly, the roller furler can be sold in kit form and be readily installed by relatively unskilled individuals using only readily available tools. In addition, the roller furlers in accordance with the present invention are relatively light in weight and flexible over their length so that they can be coiled for packaging and shipment and at the same time provides torsional rigidly after installation. The roller furling apparatus in accordance with the present invention are also durable, inexpensive to manufacturer and present a pleasing appearance without outward projections which might damage a sail.

A further feature of the present invention resides in a split drum or jib sail spool and free floating line guide which can be installed over an existing headstay with the headstay intact and in place. The split drum and free floating line guide may also be applicable for use with a more conventional furling apparatus which is installed after release of the headstay from the craft.

BRIEF SUMMARY OF THE INVENTION

In essence, the present invention contemplates a roller furling apparatus for installation on a stay of a sailboat. The furling apparatus comprises an elongated plastic member having a longitudinally extending wire or cable encased therein for torsional stiffness. The wire which is preferably a twisted stainless steel wire is preferably extruded or molded into the member. The elongated plastic member also defines a longitudinally extending opening which is generally parallel if not parallel to the wire and which is dimensioned to fit loosely around a stay on which the apparatus is installed. The plastic member also includes a grooved luff foil which extends along the length of the member and is adapted to receive a luff edge of a sail. The furling apparatus also includes bearing means about which the member rotates and a furling drum in a lower portion thereof for rotating the member about the stay to furl a sail.

A further embodiment of the present invention contemplates a roller furler apparatus for installation on a stay of a sailboat without any need to release the headstay from a water craft for installation of the apparatus. The apparatus or roller furler comprises a wire reinforced elongated plastic member or furling element which includes a pair of longitudinally extending parallel wires encased therein. The wires which are preferably a twisted stainless steel wire or cable is preferably extruded or molded into the member. The elongated plastic member defines an opening or passageway which extends there through. This passageway is dimensioned or sized to fit loosely around a stay on which the apparatus is installed. The elongated member also includes at least one and preferably two grooved luff foils which are formed in and extend along the length of the plastic member. The grooved luff foil receives the luff edge of a sail, such as a jib sail. Bearing means are also provide at or near the base of the plastic member and a furling drum or jib sail spool is provided for rotating the plastic member about a stay to furl the sail.

In a still further embodiment of the invention, the plastic member includes first and second longitudinally extending segments which extend along the length of and which divide the plastic member into two pieces. The segments each includes fastening means integrally thereof for fastening the two segments together along their length. When fastened together, the two segments define a central opening or passageway which extends around and hooks loosely on a stay. The roller furler in accordance with this embodiment of the invention also includes a relatively rigid split body member which fits around the base of the elongated plastic member and is clamped thereto, as for example, by several allen set screws. This split body member also includes a bearing element at or near the base thereof for engaging a split bearing which is installed over the stay.

The invention also contemplates the combination of the aforementioned apparatus with a split drum or jib spool. This combination may also include a free floating line guide as will be described hereinafter.

The invention will now be described in connection with the accompanying drawings wherein like reference numerals have been used to designate like parts.

DETAILED DESCRIPTION OF THE PREFERRED EMBODIMENT OF THE INVENTION

Figure 1:
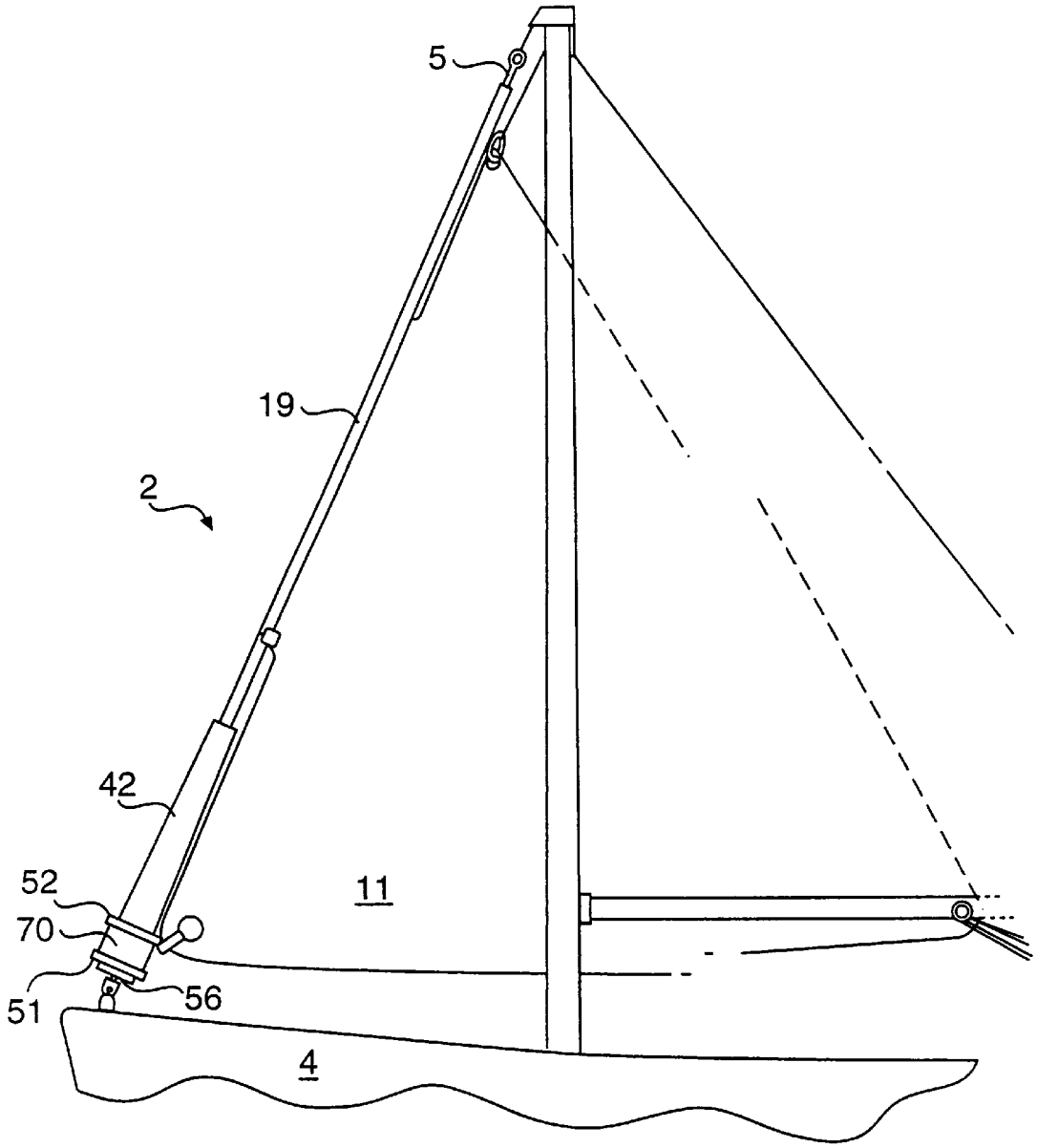
FIG. 1 is a side view of a sailboat provided with a roller furling apparatus in accordance with a preferred embodiment of the invention.
Figure 2:
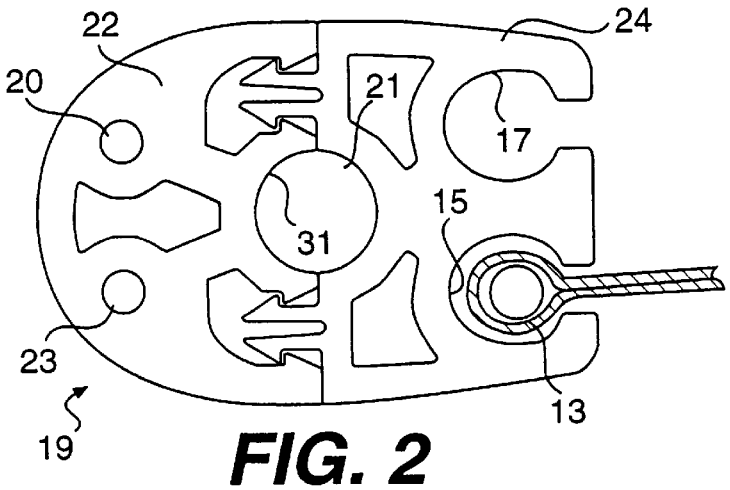
FIG. 2 is a transverse sectional view of a wire reinforced elongated plastic furling element which is employed in the embodiment of the invention which is illustrated in FIG. 1.

Referring now to FIGS. 1 and 2, a roller furling apparatus 2 is shown in a sailboat 4 as installed over a headstay 5. As illustrated in FIG. 1, the sailboat 4 carries a jib sail 11 which may take a number of forms. For example, the sail 11 may be of the type referred to as a Genoa jib which is a relatively large sail that overlaps the main sail in a conventional sloop rigged sailboat. The luff edge 13 (FIG. 2) of the sail 11 is typically provided over the major central portion of its length with a bead which fits into a grooved luff foil 15.

Figure 4:
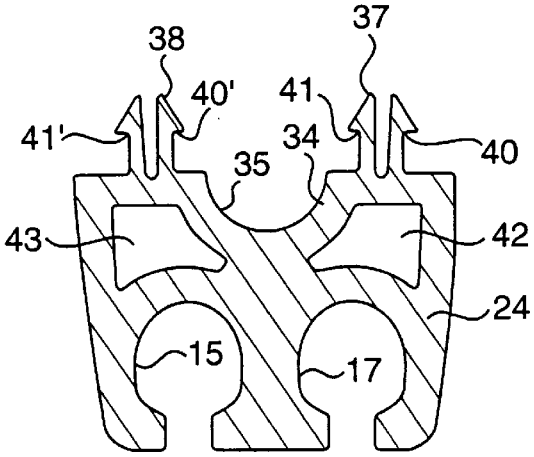
FIG. 4 is a sectional view of the tail segment of the furling element shown in FIG. 2 as it appears before assembly.

As illustrated in FIGS. 2 and 4, the roller furling apparatus 2 includes a pair of luff foils 15 and 17 either of which can receive a jib luff bead. The provision of the double grooves facilitates the use of the same rigging for racing purposes where it may be desirable to frequently change head sails so as to maintain a nearly optimum configuration.

The roller furling apparatus 2 in accordance with one embodiment of the invention comprises an elongated wire reinforced furling element or member 19 which defines or forms a passageway 21. The member 19 is preferably made of a rigid polyvinyl chloride (PVC) extrusion. The passageway 21 has a generally circular or circular cross-section which surrounds or fits over the headstay 5 upon which the apparatus is installed. The furling member 19 includes a pair of longitudinally extending metal wires 20 and 23 (FIGS. 2 and 3) which are preferably 3/32" diameter 7×19 stainless steel wire. The use of parallel wires and twisted strands are preferable since the twisted strands form a better bond with the plastic and together with the parallel structure provide a more rigid structure i.e., provide more torsional rigidity.

Figure 3:
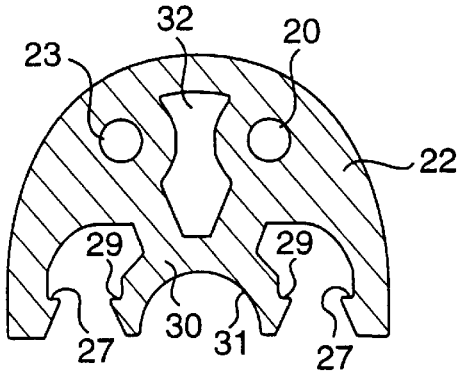
FIG. 3 is a sectional view of the forward or nose segment of the furling element shown in FIG. 2 as it appears before assembly.

In a preferred embodiment of the invention, the plastic member 19 includes 1st and 2nd longitudinally extending segments 22 and 24 (FIGS. 2–4). As illustrated, the first segment 22 or nose piece includes the longitudinally extending wires 20 and 21 extruded therein. The segment 22 also includes a pair of longitudinally extending grooves 26 and 28 which extends along the length of the segment 22. Each of the grooves includes a pair of outwardly directed shoulders 27 and 29 respectively, i.e. the shoulders project outwardly from the wall of the grooves toward one another. Each pair of shoulders 27 and 29 form a female portion of an elongated snap fastening means. The segment 22 also includes a longitudinally extending concave portion 30 having a generally semicircular surface 31. The segment 22 may also include a second passageway 32 which reduces the weight of the segment, the amount of plastic required and contributes to the longitudinal flexibility of the segment.

The second longitudinally extending segment 24 or tail section includes the luff foils 15 and 17 and is made of an extruded plastic and of the same material as the nose piece. The second segment 24 also includes a complimentary longitudinally extending concave portion 34 which has a generally semicircular or semicircular surface 35. When aligned, the concave portions 30 and 34 form the passage 21 which surrounds the headstay 5 on which the apparatus is installed. The segment 24 also includes a pair of longitudinally extending outwardly projecting male fastening means 37 and 38 each of which includes a pair of spaced apart and outwardly biased shoulders 40, 41, 40' and 41'. The segment 24 may also include a pair of longitudinally extending passageways 42 and 43 which further reduce the amount of plastic in the extrusions and contributes to the lite weight of the apparatus.

When the segments 22 and 24 are aligned i.e., at the top and bottom thereof with one on each side of the head or jib stay 5, they are snapped together to form a unitary structure as shown in FIG. 2.

One preferred embodiment of the invention also includes a frusto conically shaped split body member 42 (see FIG. 5) which forms a lower portion of the apparatus 2. The body member 42 is preferably made of glass reinforced nylon. The member 42 includes two longitudinally extending segments 43 and 44 which together define or form a central passageway 45 which fits around a lower portion of the head or jib stay 5.

Figure 7:
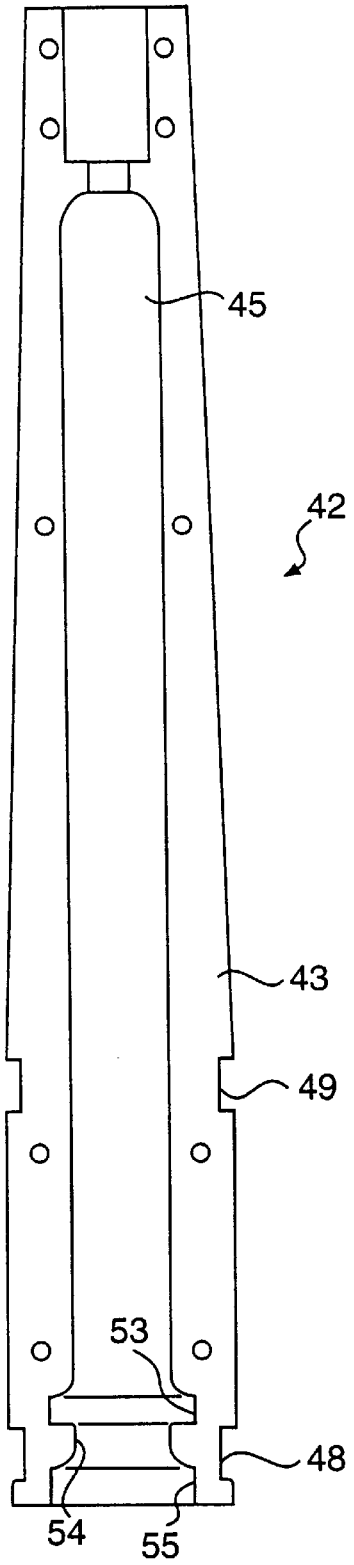
FIG. 7 is a side or plan view showing the other half of the body member of FIG. 6.
Figure 8:
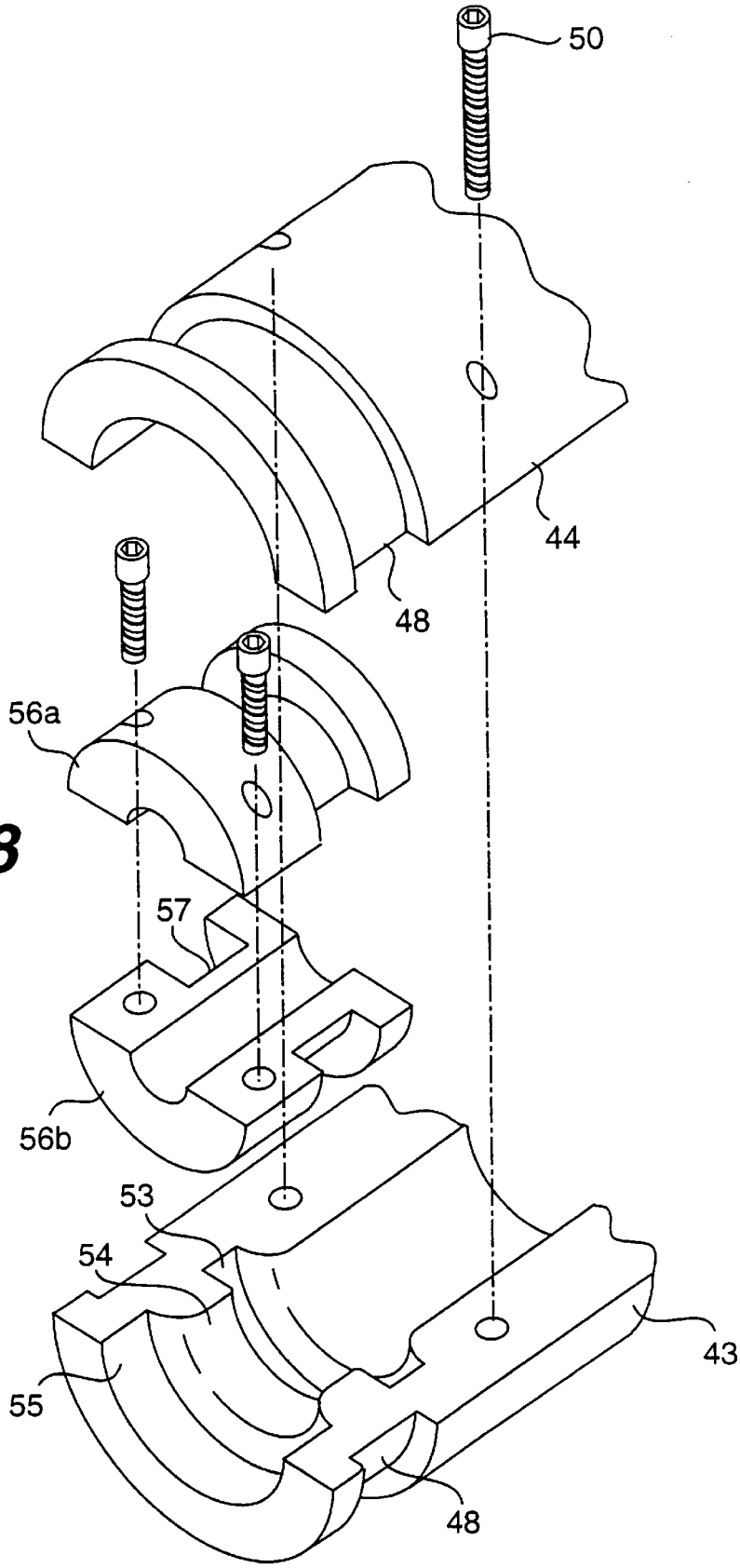
FIG. 8 is an exploded perspective view which illustrates a split bearing as used in the apparatus in accordance with the present invention.

The body member 42 encompasses a turnbuckle 47 of the headstay 5 within the passageway 45 and also includes a pair of external transverse grooves 48 and 49 as shown more clearly in FIG. 7. The grooves 48 and 49 extend around the body member 42 in a lower portion thereof when the longitudinally extending segments 43 and 44 are aligned and fastened together about the stay 5. The segments 43 and 44 are fastened together by conventional means such as a plurality of allen set screws 50 as illustrated in FIG. 8.

Figure 5:
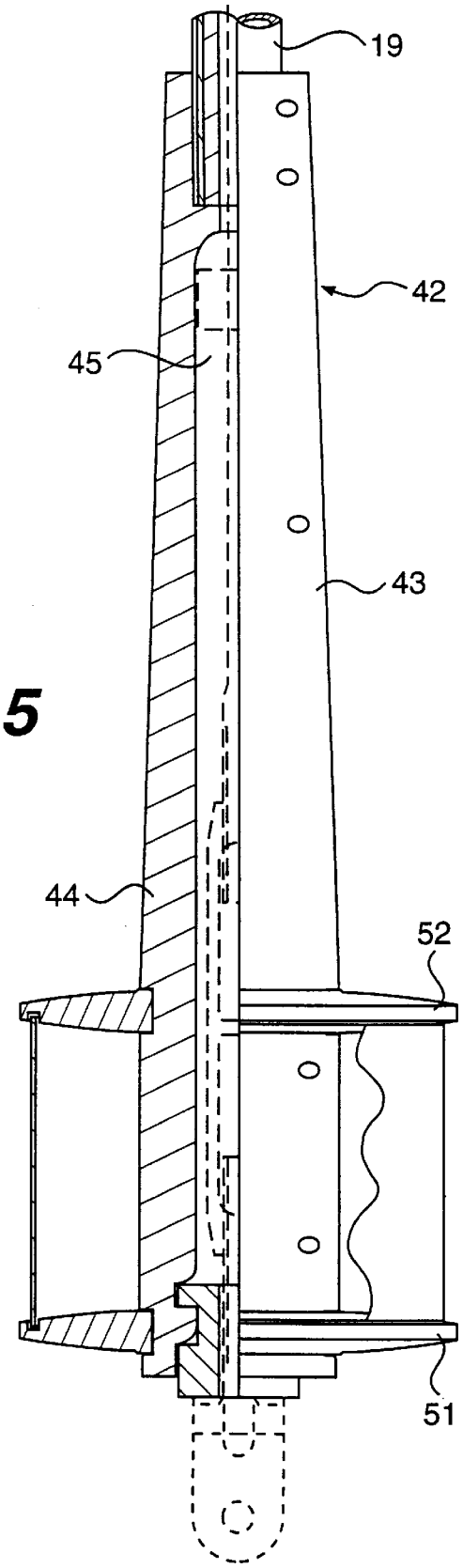
FIG. 5 is a side or plan view partially in section which illustrates a lower portion of the roller furling apparatus in accordance with one embodiment of the invention.
Figure 6:
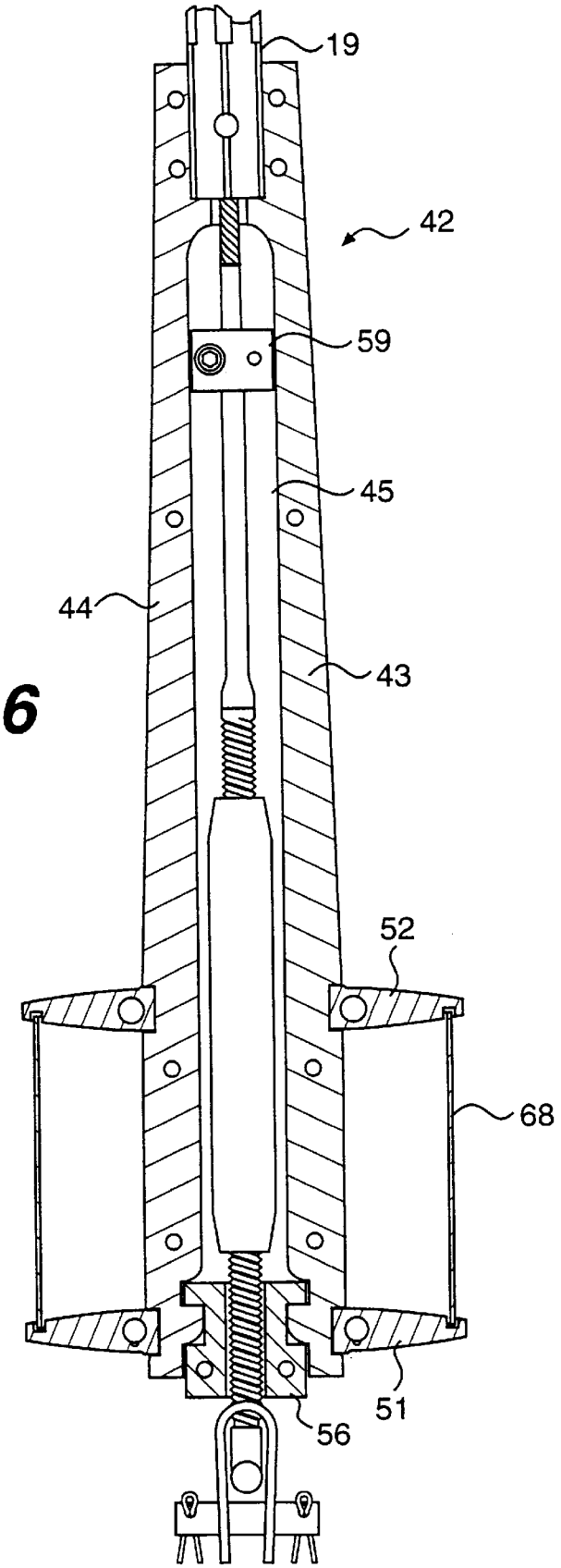
FIG. 6 is a second side or plan view of the portion of the apparatus shown in FIG. 5 after rotating the portion 90° and with one half of a lower body member removed.
Figure 10:
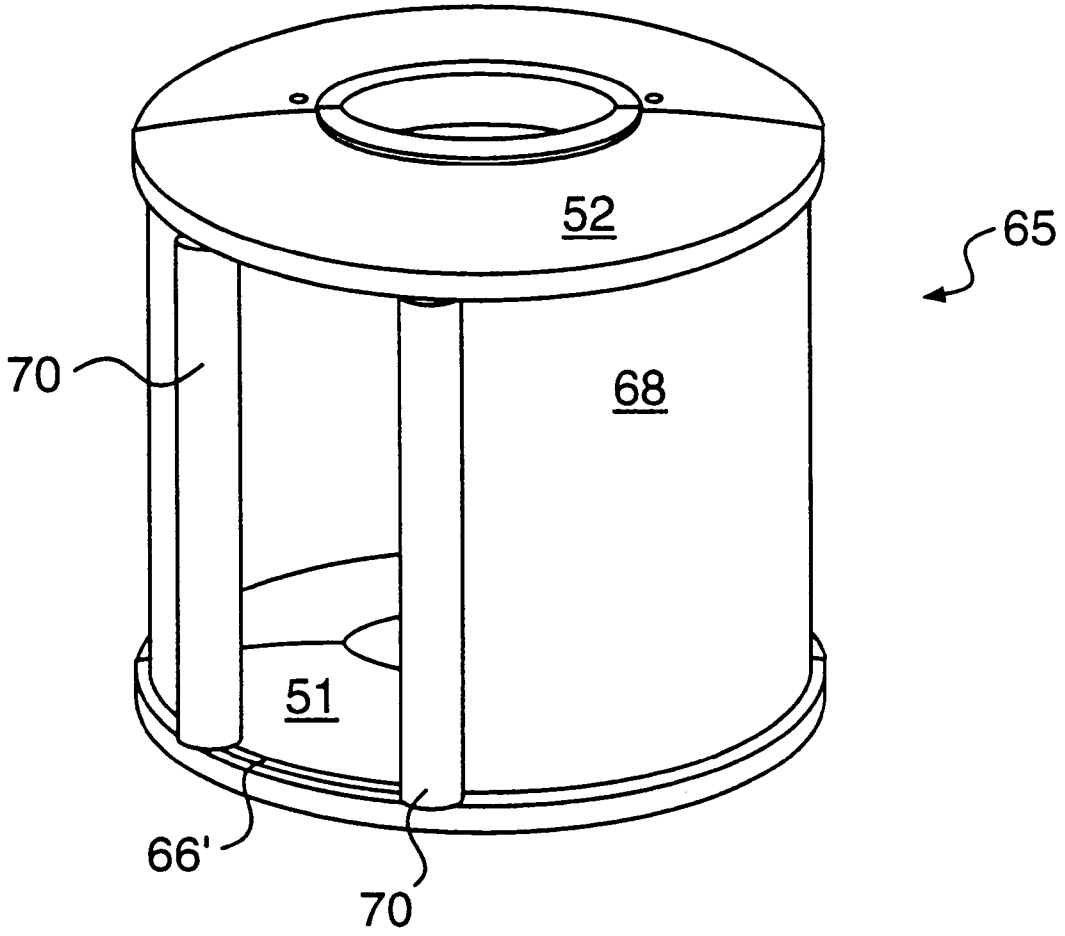
FIG. 10 is a perspective view of the jib spool or drum and floating line guide in accordance with the invention.

The grooves 48 and 49 are constructed and arranged to receive a pair of split flanges 51 and 52 therein as shown in FIGS. 5 and 6. When the split flanges 51 and 52 are snapped around the body member 42 within the grooves 48 and 49 they form a drum or jib spool (see FIGS. 5, 6 and 10) which contains a line or a rope between the flanges. The longitudinally extending segments 43 and 44 each include a pair of transverse internal grooves 53 and 55 (see FIGS. 7 and 8) and a tongue or inwardly directed projection 54 which acts as a is bearing element at the base of the body member 42. This lower bearing element clamps around a lower split bearing 56 (see FIG. 6 and 8). The split bearing 56 comprises two halves **56*a* and 56*b* which are clamped around the stay 5 and held in place about the stay by recessed Allen set screws. The bearing 56 also includes a groove 57 in an outer surface thereof and a pair of outward projections which fit within grooves 53 and 55** to complete a lower bearing assembly.

A preferred embodiment of the invention also includes a split nylon spacer 59 in an upper portion of the passageway 45. In essence, the spacer 59 is a generally cylindrical element including two halves which are held together by two allen set screws as shown in FIG. 6. The spacer 59 also defines a cylindrical passageway and clamps around the headstay 5 or a portion of the turnbuckle 47 as shown.

Each of the split flanges 51 and 52 also includes a pair of pins 60 and recesses 62 as well as a ball 61 and detente 63 for snapping the two halves of the flanges together in alignment and for holding the flanges in an abutting relationship with the body member 42.

Figure 9:
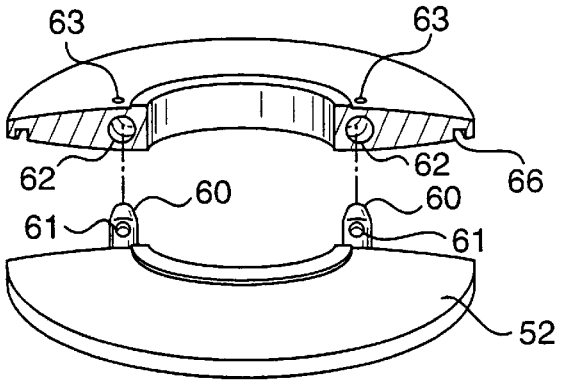
FIG. 9 is an exploded perspective view of a split flange as used in the apparatus in accordance with the present invention.
Figure 11:
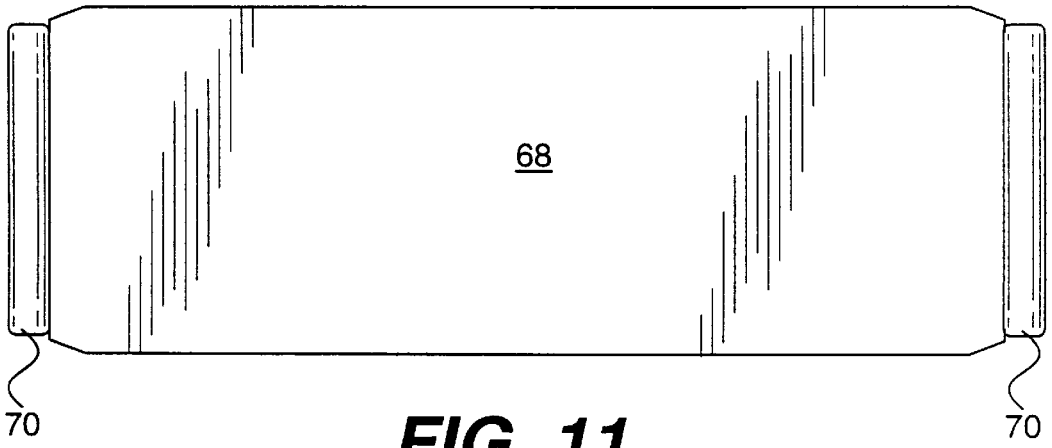
FIG. 11 is a plan view of the slide element as used in the line guide in accordance with the invention but prior to installation.

A floating line guide 65 will be described in connection with FIGS. 5, 6 and 9–11. As illustrated in FIG. 9, each of the flanges 51 and 52 include a shallow groove 66 and 66' which extend around an outer portion of the flange. The sliding element 68 is disposed within the grooves 66, 66' and rotates freely about the body member 42 within the grooves 66, 66'. This sliding element 68 may be made from a sheet of polyethylene or polypropylene or other suitable material. The sliding element may also include a pair of cylindrical elements 70 at each end thereof to protect the sliding element from wear as a line or rope rubs against the element when furling or unfurling a sail. This floating line guide may for example, extend around the flange through an angle of about 270° to 330°.

Figure 12:
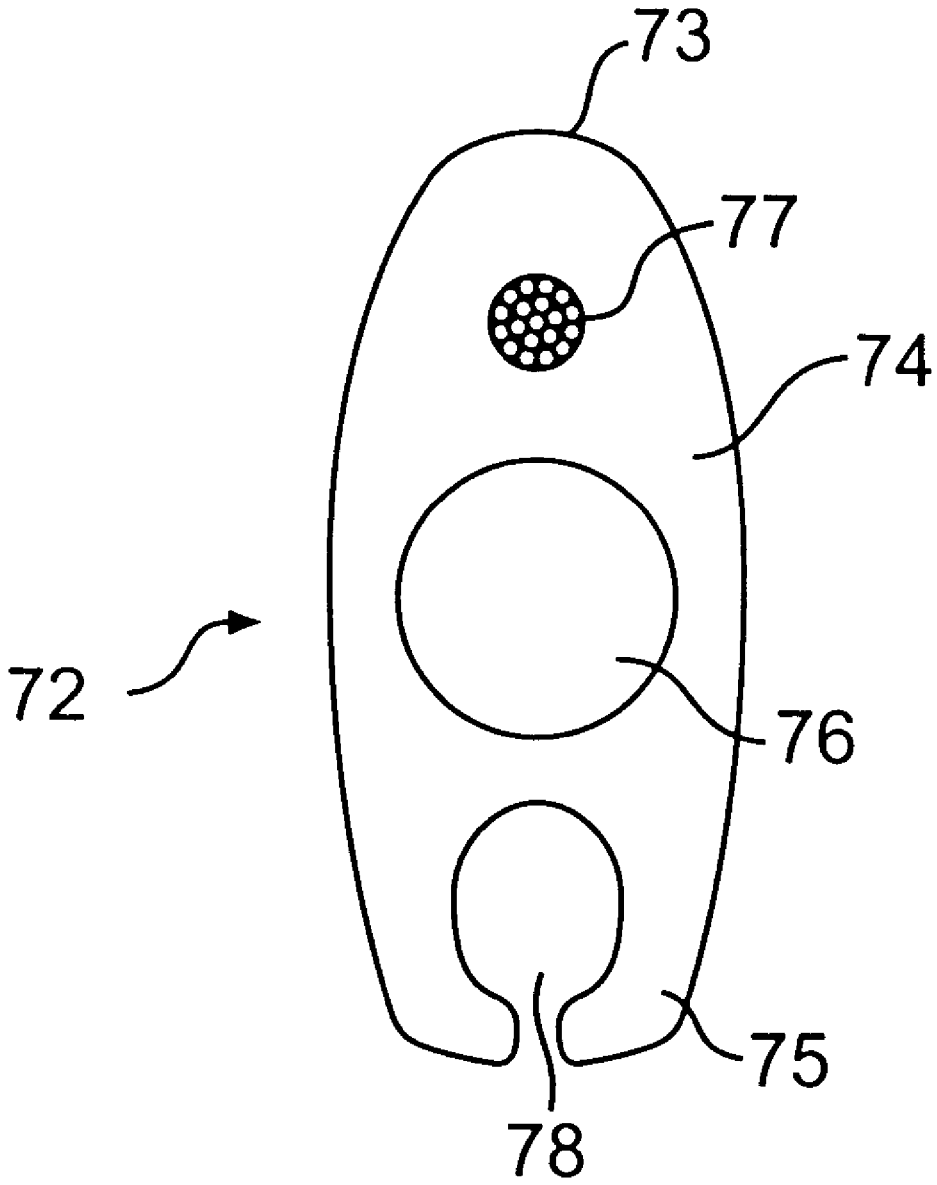
FIG. 12 is a cross sectional view of a single piece furling element with a single wire reinforcement and single luff groove in accordance with one embodiment of the invention.

As shown in FIG. 12, a single piece furling element or apparatus 72 comprises a longitudinally extending plastic body 74. This plastic body 74 includes a nose portion 73 and tail portion 75 which together form an integral one piece constriction which may be formed by conventional extrusion techniques. The body 74 also defines a longitudinally extending passageway 76 which is dimensioned to fit loosely about the forward stay of a sailboat. The passageway 76 is preferably positioned in a central portion of the body 74.

The furling element or apparatus 72 also includes a longitudinally extending braided wire 77 which extends along the length of the element 72 in the forward portion thereof i.e. between the nose portion 73 and passageway 76. This braided wire 77 or cable is generally parallel with the passageway 76. The furling apparatus 72 also includes a longitudinally extending luff foil or furling groove 78 which is adopted to receive the luff edge of a sail in a conventional manner.

While the single piece furling apparatus 72 is relatively inexpensive to produce, it does require the release of the forward stay on a sailboat for installation. Nevertheless, it is believed that there is a relatively large market for the relatively low cost design.

Figure 13:
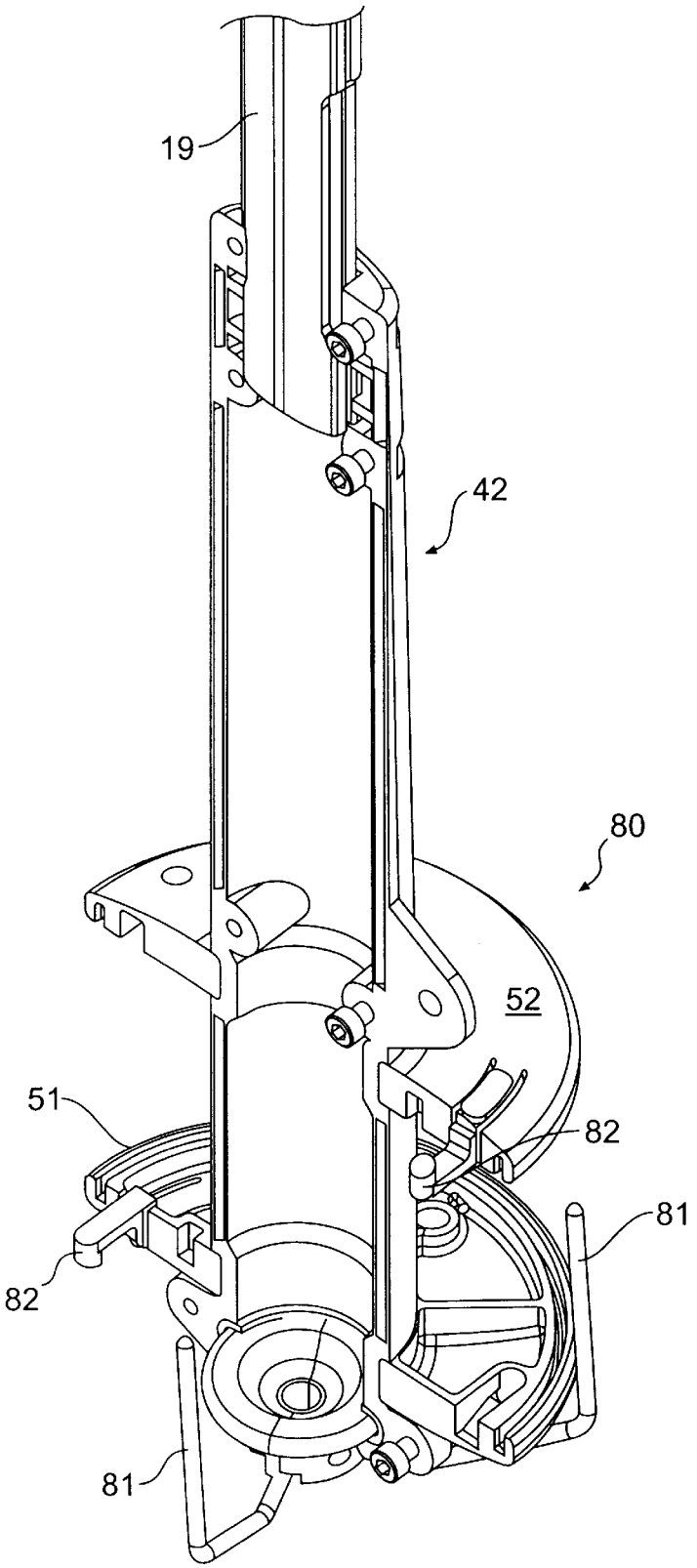
FIG. 13 is a cross sectional view of a lower portion of a furling apparatus which includes a bearing assembly in accordance with a preferred embodiment of the invention.
Figure 14:
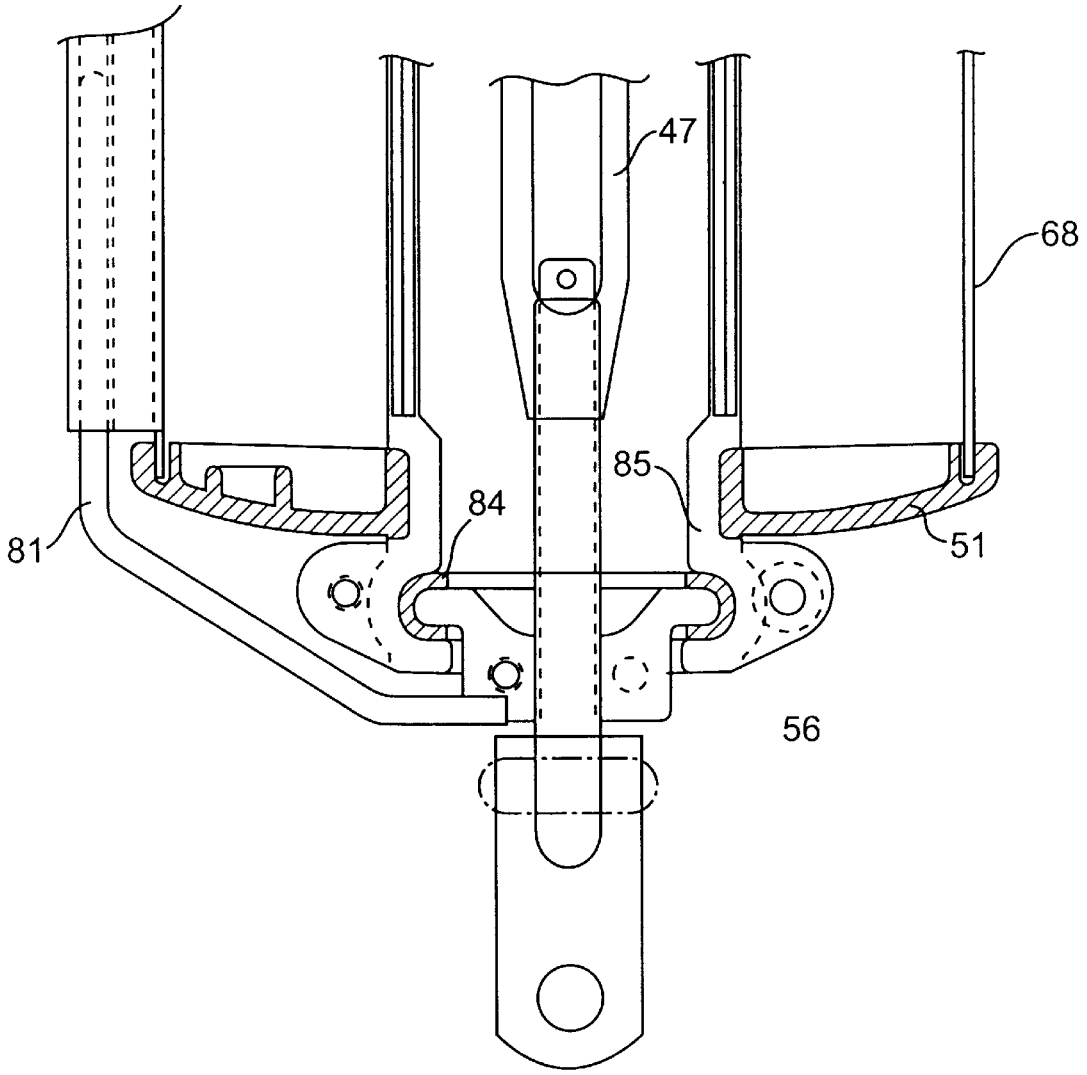
FIG. 14 is a perspective view which shows ½ of a split body member and a portion of a longitudinally extending plastic member positioned for being clamped between two halves of the split body member.

FIGS. 13 and 14 are perspective views of a frustoconically shaped split body member 42 and a split furling drum 80 with a pair of line guides 81. As shown in FIG. 14, the body member 14 includes a longitudinally extending passageway which is sized to encompass the turnbuckle 47. A pair of spring biased fastening pins 82 or other conventional means are used to fasten the two halves of the split discs or flanges 51 and 52 together.

As shown in FIG. 14 a split bearing 56 may be made of metal and include a nylon sleeve 84. This nylon sleeve 84 then fits within a groove within a lower portion 85 of the body member 42.

While the invention has been defined in accordance with its preferred embodiments, it should be recognized that changes and modifications may be made therein without departing from the scope of the appended claims.

What is claimed is:

1. A roller furling apparatus for installation on a stay of a sailboat comprising a wire reinforced elongated plastic member having a longitudinally extending wire encased therein for torsional stability, said plastic member defining a longitudinally extending opening therethrough and dimensioned to fit loosely around a stay on which the apparatus is installed, a grooved luff foil extending along t he length of said member for receiving a luff edge of a sail, bearing means about which said member rotates and a furling drum for rotating said member about a stay for furling a sail.

2. A roller furling apparatus for installation on a stay of a sailboat in accordance with claim 1 in which said wire reinforced elongated plastic member is a single integral extrusion with a single wire therein.

3. A roller furling apparatus for installation on a stay of a sailboat in accordance with claim 2 in which said elongated plastic member has a generally oval cross section with forward and rear portions and with said longitudinally extending passageway disposed between said forward and rear portions, and in which said longitudinally extending wire is a braided cable which is generally parallel to said longitudinally extending passageway and disposed in said forward portion and in which said grooved luff foil is disposed in said rear portion.

4. A roller furling apparatus according to claim 3 which includes a two piece plastic base member with upper and lower portions and a hollow center dimensioned to fit around a turn buckle, said base member constructed and arranged to clamp said wire reinforced elongated member therein and with a pair of split flanges thereon in a lower portion thereof forming said furling drum.

* * * * *